US007596348B2

(12) United States Patent
Nakamoto et al.

(10) Patent No.: US 7,596,348 B2
(45) **Date of Patent: *Sep. 29, 2009**

(54) IMAGE HEATING APPARATUS

(75) Inventors: Ikuo Nakamoto, Toride (JP); Yasuhiro Hayashi, Moriya (JP); Daigo Matsuura, Toride (JP); Kazuhiro Hasegawa, Toride (JP); Shigeaki Takada, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/678,680

(22) Filed: Feb. 26, 2007

(65) Prior Publication Data

US 2007/0140760 A1 Jun. 21, 2007

Related U.S. Application Data

(62) Division of application No. 11/452,204, filed on Jun. 14, 2006, now Pat. No. 7,200,354.

(30) Foreign Application Priority Data

Jun. 21, 2005 (JP) ..... 2005/180540

(51) Int. Cl.
*G03G 15/20* (2006.01)

(52) U.S. Cl. ..... 399/329; 399/330; 399/331; 399/333; 219/216

(58) Field of Classification Search ..... 399/328–331, 399/333; 219/216
See application file for complete search history.

(56) References Cited

U.S. PATENT DOCUMENTS 5,293,537 A * 3/1994 Carrish ..... 399/329
5,319,429 A 6/1994 Fukuchi et al. ..... 355/290
5,621,512 A 4/1997 Uehara et al. ..... 399/328
6,583,393 B1 6/2003 Ota ..... 219/619
7,024,145 B2 4/2006 Aruga et al. ..... 399/329
7,200,354 B2 * 4/2007 Nakamoto et al. ..... 399/329
2004/0161271 A1 8/2004 Tanino et al. ..... 399/329
2005/0047838 A1 3/2005 Uehara et al. ..... 399/329
2005/0220507 A1 10/2005 Uehara et al. ..... 399/329

FOREIGN PATENT DOCUMENTS

EP 1 496 405 1/2005
EP 1 496 406 A1 1/2005
EP 1 703 338 A1 9/2006
JP 2004-341346 12/2004

OTHER PUBLICATIONS

Korean Office Action dated Aug. 22, 2007.

* cited by examiner

*Primary Examiner*—David M Gray
*Assistant Examiner*—Geoffrey T Evans
(74) *Attorney, Agent, or Firm*—Fitzpatrick, Cella, Harper & Scinto

(57) ABSTRACT

An image heating apparatus comprising first and second belts for forming a nip for heating an image on a recording material; a first pressing pad for pressing the first belt at the nip; a first roller, provided spaced from the first pressing pad with a gap therebetween, for pressing the first belt at the nip; a second pressing pad, provided opposed to the first pressing pad, for pressing the second belt at the nip; a second roller, provided opposed to the first roller and contacted to the second pressing pad, for pressing the second belt at the nip, the second roller having a friction coefficient which is smaller than that of the first roller.

7 Claims, 6 Drawing Sheets

IMAGE HEATING APPARATUS

This application is a divisional of U.S. patent application Ser. No. 11/452,204, filed Jun. 14, 2006.

FIELD OF THE INVENTION AND RELATED ART

The present invention relates to an image heating apparatus for heating an image formed on recording medium. Such an image heating apparatus is employed by a copying machine, a printing machine, a facsimile machine, etc.

A fixing apparatus for an electrophotographic image forming apparatus fixes a toner image formed on a sheet of recording medium, to the sheet of recording medium, by applying pressure to the toner image while heating it. As one of various fixing apparatuses, there is a so-called roller-based fixing apparatus, which is made up of a fixation roller and a pressure application roller (which hereafter will be simply referred to as pressure roller). The fixation roller and pressure roller are pressed against each other to form a fixation nip. A roller-based fixing apparatus has long been used in the field of electrophotographic image forming apparatuses.

For the purpose of raising the glossiness level at which an image forming apparatus forms an image, or the image formation speed of an image forming apparatus, it is desired to fully melt toner by extending the length of time it takes for a sheet of recording medium to pass a fixation nip. In order to extend the length of time it takes for a sheet of recording medium to pass the fixation nip of a roller-based fixing apparatus in accordance with the prior art, its fixation roller and pressure roller must be increased in diameter, and therefore, the fixing apparatus must be increased in size.

As one of the solutions to this dilemma, Japanese Laid-open Patent Application 2004-341346 proposes a so-called belt-based fixing method. This method can make it possible to provide a fixing apparatus which is greater in nip width (in terms of sheet conveyance direction), being therefore satisfactory for fully melting toner, and yet, is smaller in size and higher in fixation speed, than a roller-based fixing apparatus in accordance with the prior art. A fixation belt-based fixing method (which hereafter will be referred to simply as belt-based fixing method) such as the abovementioned one employs a fixation belt and a pressure application belt to form a fixation nip, which is long (in terms of recording medium sheet conveyance direction) enough to fully melt toner.

However, the fixing apparatus disclosed in Japanese Laid-open Patent application 2004-341346 suffers from the following problems. That is, the fixation nip formed between the two belts has a high pressure portion, a low pressure portion, and a portion with virtually no pressure. The high pressure portion coincides with the portion of one of the belts, and the portion of the other belt, to which pressure is applied by one of a pair of rollers by which one of the two belts is suspended and one of the other pair of rollers by which the other belt is suspended. The low pressure portion coincides with the portion of one of the belt, and the portion of the other belt, to which pressure is applied by only a fixation pad. The pressure portion with virtually no pressure coincides with the portion of one of the belts, and the portion of the other belt, to which no pressure is applied.

Therefore, the high pressure portion of the fixation nip and the low pressure portion of the fixation nip are different in recording sheet conveyance speed. Further, the belts are slightly flexible. Therefore, while the belts are rotated (circularly moved), they stretch or shrink in response to the changes in the abovementioned recording sheet conveyance speed.

This change in the recording sheet conveyance speed causes the unfixed toner image on the sheet of recording medium to deviate in position, while the sheet of recording medium on which the unfixed toner is borne is conveyed through the fixation nip.

On the other hand, the portion of the fixation nip, which has virtually no pressure, fails to confine the steam which generates as heat is applied. Therefore, the portion with virtually no pressure becomes nonuniform (in terms of direction perpendicular to sheet conveyance direction) in the amount of steam; some areas of the portion with virtually no pressure have more air and steam than the other areas, and some areas have no air and steam. This renders the portion with virtually no pressure nonuniform in the state of contact between the toner image and belt. The nonuniformity in the state of contact between the toner image and belt causes the fixing apparatus to yield an image which is nonuniform in glossiness, in particular, when a sheet of recording medium such as a sheet of coated paper which is low in air permeability is used as recording medium.

SUMMARY OF THE INVENTION

The primary object of the present invention is to provide an image heating apparatus which is structured to form a nip with the use of first and second belts, and which does not suffer from the problem that an image is unsatisfactorily heated.

Another object of the present invention is to provide an image heating apparatus which is structured to form a nip with the use of first and second belts, and forms a fixation nip having no area which is substantially lower in pressure than the adjacent areas.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the present invention will be concretely described with reference to the preferred embodiments of the present invention. The following embodiments of the present invention are some of the preferred embodiments of the present invention, and are not intended to limit the scope of the present invention. In other words, this application is intended to cover such modifications or changes which may result from the improvements made within the gist of the present invention.

Embodiment 1

First, referring to FIG. 6, the general structure of a typical image forming apparatus will be described.

Figure 6:
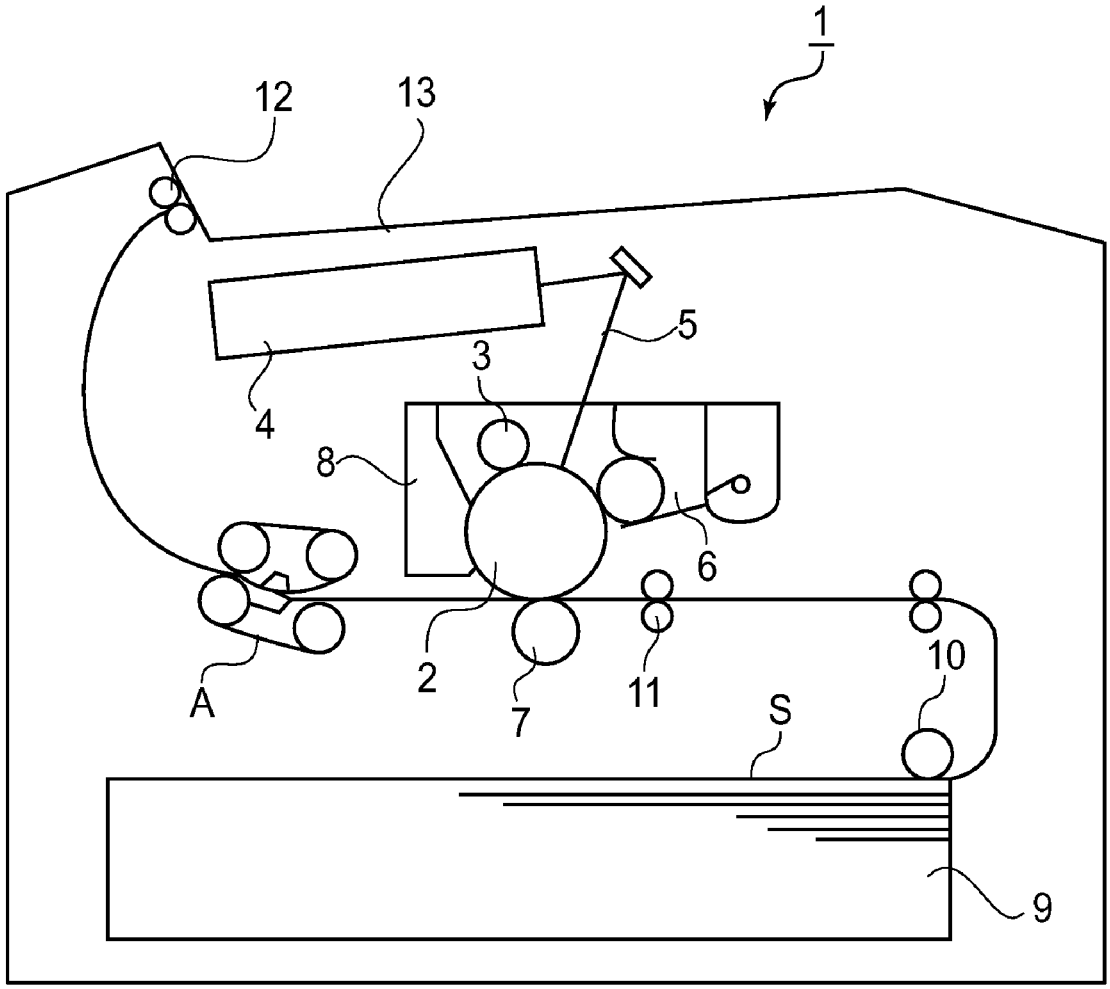
FIG. 6 is a schematic sectional view of a typical image forming apparatus, depicting the general structure thereof.

The image forming apparatus shown in FIG. 6 is an image forming apparatus (so-called printer) which employs an electrophotographic image forming method.

The image forming apparatus 1 can be roughly divided into an image forming means for forming a toner image on a sheet of recording medium, and a fixing apparatus, as an image heating apparatus, for fixing the toner image formed on the sheet of recording medium, by applying heat and pressure to the toner image.

The image forming means is equipped with a photosensitive drum 2 as an image bearing member, a charging device 3 as a charging means, an exposing apparatus as an exposing means, a developing device 6 as a developing means, a recording medium feeder cassette 9; a feeding-and-conveying roller 10, a pair of registration rollers 11, a transfer roller 7 as a transferring means, and a cleaning apparatus 8 as a cleaning means. The charging member 3 is disposed next to the peripheral surface of the photosensitive drum 2, and the peripheral surface of the photosensitive drum 2 is uniformly charged by the charging device 3. The uniformly charged portion of the peripheral surface of the photosensitive drum 2 is exposed to a beam of light 5 which the exposing apparatus 4 emits while modulating it with image formation information. As a result, an electrostatic latent image is formed on the peripheral surface of the photosensitive drum 2. This electrostatic latent image is developed by the developing device 6 into an image formed of toner, or a toner image. In the recording medium feeder cassette 9, multiple sheets S of recording medium are stored. Each sheet S of recording medium is fed into the main assembly of the image forming apparatus by the feeding-and-conveying roller 10, and is conveyed further by the pair of registration roller 11 in synchronization with the progression of the formation of the toner image. The toner image on the peripheral surface of the photosensitive drum 2 is electrostatically transferred onto the sheet S of recording medium by the transfer roller 7. Then, the sheet S of recording medium bearing the toner image is conveyed to the fixing apparatus A. The toner remaining on the peripheral surface of the photosensitive drum 2 is removed by the cleaning apparatus 8.

The toner image formed on the sheet S of recording medium by the image forming means is subjected to heat and pressure by the fixing apparatus A, which is an image heating apparatus, being thereby fixed to the surface of the sheet S. Thereafter, the sheet S to which the toner image has just been fixed is conveyed further and is discharged by a pair of discharge rollers 12 into a delivery tray 13which constitutes the top portion of the image forming apparatus.

Figure 1:
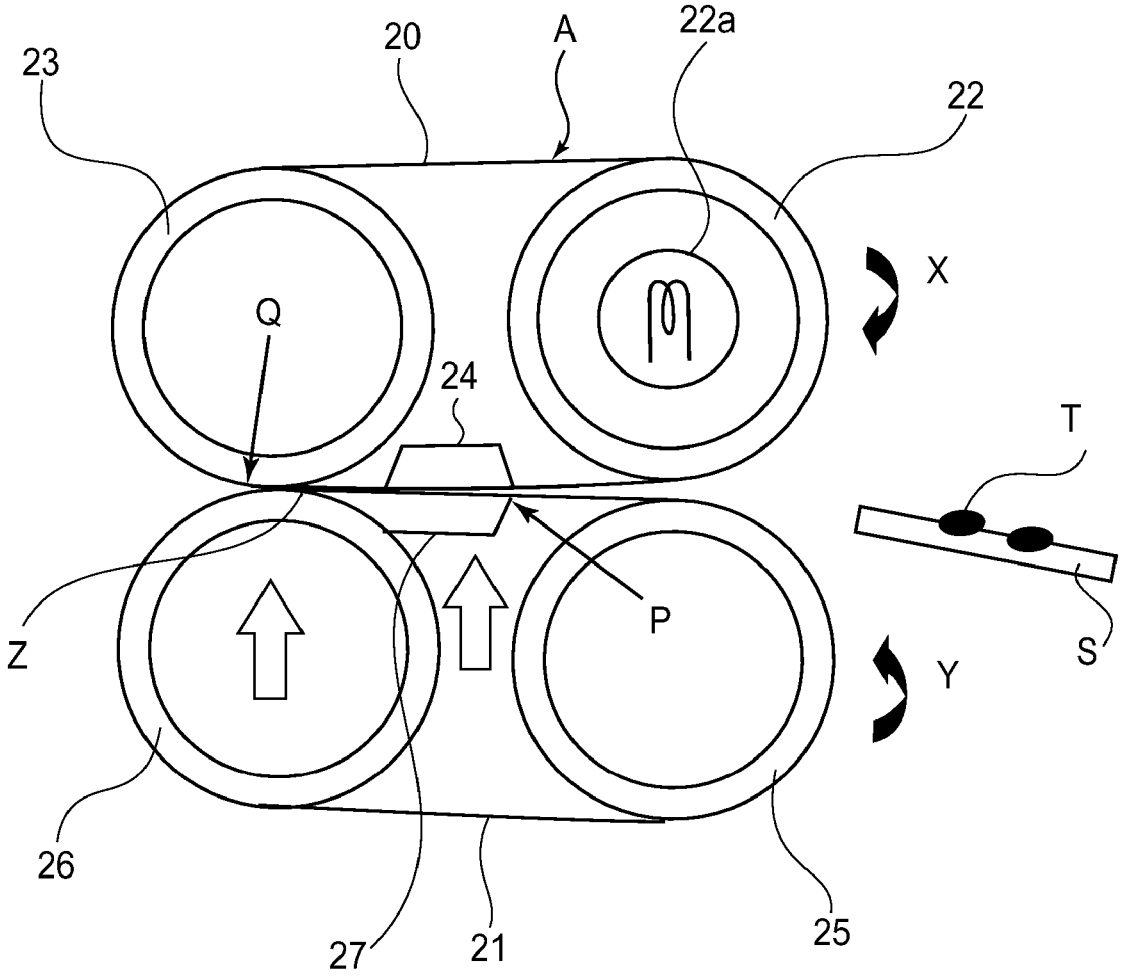
FIG. 1 is a sectional view of the fixing apparatus in the first preferred embodiment of the present invention.
Figure 2:
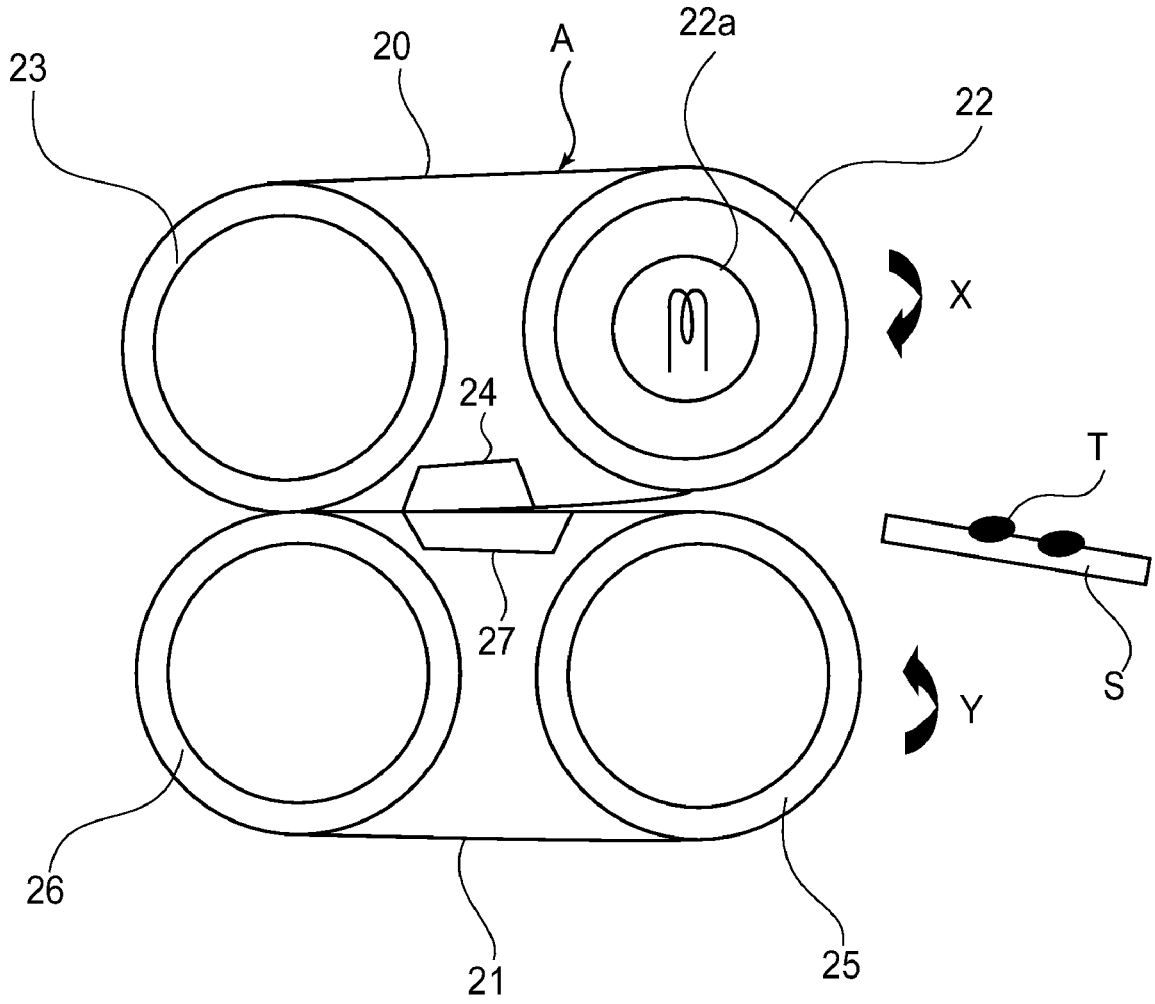
FIG. 2 is a sectional view of the first comparative fixing apparatus.

FIG. 1 is a sectional view of the fixing apparatus A, and FIG. 2 is a sectional view of a comparative fixing apparatus. As shown in the drawings, the fixing apparatus A is provided with a fixing belt 20 (fixing means) as an example of a first belt, and a pressure application belt (pressure applying means) 21 as an example of a second belt. The fixing apparatus A is structured so that heat and pressure are applied to the toner image on a sheet S of recording medium while the sheet S is conveyed through the fixation nip (image heating nip) formed between the fixation belt 20 and pressure application belt 21, remaining pinched between the fixation belt 20 and pressure application belt 21. Thus, as the sheet S is conveyed through the fixation nip, the toner image is fixed to the sheet S; after the passage of the sheet S through the fixation nip, the sheet S bears a fixed toner image.

The fixation belt 20 is 40 mm in internal diameter. It is made up of a base layer and an elastic layer. The base layer is formed of polyimide and is 75 μm in thickness. The elastic layer is formed on the outward surface of the base layer (in terms of fixation belt loop) and is 300 μm in thickness. As the material for the elastic layer, one of the known elastic substances, for example, silicone rubber, fluorinated rubber, or the like, may be used. In this embodiment, silicone rubber is used, which is 20 degrees in hardness (JIS-A scale), and 0.8 W/mK in coefficient of thermal conductivity. The deformation of this elastic layer is utilized to prevent the sheet S of recording medium from wrapping around the fixation belt 20; it is utilized to facilitate the separation of the sheet S from the fixation belt 20. The fixation belt 20 is also provided with a release layer as the surface layer, which is formed on the outward surface of the elastic layer, of fluorinated resin (for example, PFA or TFE). The release layer is 30 μm in thickness.

The pressure application belt 21 is 40 mm in internal diameter. It is formed of a base layer and a release layer which constitutes the surface layer. The base layer is 75 μm in thickness, and is formed of polyimide. The release layer is formed of fluorinated resin, more specifically, PFA tube. The release layer is 30 μm in thickness.

The fixation belt 20 is suspended by a heat roller 22 and a fixation roller 23, which also function as fixation belt suspending rollers. The heat roller 22 is a hollow iron roller, which is 20 mm in external diameter, 18 mm in internal diameter, and 1 mm in thickness. Within the hollow of the heat roller 22, a halogen heater **22*a* as a heating means is disposed. The heat roller 22 functions as a tension roller. The fixation roller 23 functions as a driving roller for driving the fixation belt 20**.

The fixing apparatus A is provided with a temperature sensor, which is disposed in contact, or virtually in contact, with the portion of the outward surface of the fixation belt 20, which corresponds in position to the heat roller 22. The signals representing the temperature of the fixation belt 20 are outputted from this temperature sensor and are inputted into a controller (CPU). The fixing apparatus A is structured so that as the controller receives these signals, it turns on or off the power supply to the halogen heater, in response to the signals, to maintain the temperature of the fixation belt 20 at a preset fixation temperature (190° C. in this embodiment).

The fixation roller 23 as the first roller (high friction roller) is 20 mm in external diameter. It is made up of a metallic core, and an elastic layer which constitutes the surface layer. The metallic core is formed of iron alloy, and is 18 mm in thickness. The elastic layer is formed of silicone rubber. In other words, the fixation roller 23 is a high friction rubber roller. The provision of the elastic layer prevents the fixation belt 20 from slipping on the fixation roller 23. Therefore, as driving force is inputted from a driving force source (motor) into the fixation roller 23 through a gear train, it is efficiently transmitted to the fixation belt 20. Further, a pressure application roller 26 is kept pressed against the fixation roller 23, with the fixation belt 20 and pressure application belt 21 pinched between the two rollers 26 and 23, as will be described later. Therefore, the portion of the rubber layer of the fixation roller 20 is indented by a preset amount, forming a nip which ensures that the sheet S of recording medium is separated from the fixation belt 20. Further, as it will be described later, the fixing apparatus A is structured so that the pressure of the fixation nip is highest across the portion of the fixation nip, which corresponds to the portion of the fixation belt 20 pinched between the two rollers 26 and 23.

As the silicone rubber as the material for the fixation roller 23, a silicone rubber, which is 15 degrees in hardness (JIS-A scale) and 0.8 W/mK in coefficient of thermal conductivity, is used. Therefore, this silicone rubber layer reduces the inward heat conduction of the fixation roller 23, being therefore effective to reduce the warm-up time.

The coefficient of friction of the silicone rubber layer as the surface layer of the fixation roller 23 is large. Therefore, when the rotational force is inputted into the fixation roller 23 through the gear train, the silicone rubber layer of the fixation roller 23 prevents the polyimide layer, or the inward layer, of the fixation belt 20 from slipping on the fixation roller 23. Therefore, as the rotational force is inputted, the fixation belt 20 properly rotates.

A fixation pad 24 is a first pressure application pad which keeps the fixation belt 20 pressed toward the pressure application belt 21. It is disposed in parallel to the fixation roller 23, and also, is disposed so that there will be no contact between the fixation roller 23 and fixation pad 24. In this embodiment, the fixing apparatus A is structured so that the shortest distance between the fixation roller 23 and fixation pad 24 is 3 mm.

The fixation pad 24 is formed of heat resistant elastic material, more specifically, heat resistant silicone rubber. It is 3 mm in thickness and 12 mm in width.

Further, in order to reduce the frictional resistance of the fixation pad 24 against the inward surface of the fixation belt 20, by which the fixation belt 20 slides on the fixation pad 24, the fixation pad 24 is provided with a cover formed of a low friction sheet, which is formed by coating glass fiber cloth with fluorinated resin. This cover covers the surface of the high friction silicone rubber of which the fixation pad 24 is formed. Therefore, the inward surface of the fixation belt 20 slides on this cover. In other words, the provision of this cover reduces the amount of torque necessary to drive the fixation roller 23, making it unnecessary to employ a larger motor to reliably rotate the fixation belt 20.

The pressure application belt 21 is suspended by a tension roller 25 and a pressure application roller 26, which also function as belt suspension rollers. The tension roller 25 is 20 mm in external diameter. It is made up of a metallic core and a silicone sponge layer. The metallic core is 16 mm in diameter and is formed of an iron alloy. The silicone sponge layer is formed on the peripheral surface of the metallic core to reduce the heat conduction to the tension roller 25 from the pressure application belt 21. The pressure application roller 26 as the second roller (low friction roller) is 20 mm in external diameter. It is a metallic roller formed of an iron alloy. It is 16 mm in internal diameter and 2 mm in thickness. It is a low friction roller. The roughness of the surface of the pressure application roller 26 is set to render the pressure application roller 26 slippery. More specifically, the roughness of the pressure application roller 26 is set so that the coefficient of friction between the pressure application roller 26 and pressure application belt 21 becomes no less than 0.005 and no more than 0.3.

The fixing apparatus A is structured so that after the fixation nip is formed and the fixing apparatus A becomes ready for fixation, the tension roller 25 and pressure application roller 26 are rotated by the pressure application belt 21 as rotational driving force is transmitted to the pressure application belt 21 from the pressure application belt 21.

Incidentally, in order to keep the pressure application unit, which includes the pressure application belt 21, separated from the fixation unit which includes the fixation belt 20, when the fixing apparatus A is not being used for fixation (while it is kept on standby), the fixing apparatus A may be structured so that the pressure application unit can be separated from the fixation unit by a mechanism for separating the pressure application unit from the fixation unit, or placing the pressure application unit in contact with the fixation unit. Further, a fixing apparatus structured as described above may be given an additional structural feature so that while the pressure application belt 21 is kept separated from the fixation belt 20, the pressure application roller 26 can function as a driving roller, that is, the pressure application belt 21 can be rotationally driven by the pressure application roller 26 to which driving force is inputted from a driving mechanism.

The pressure application pad 27 is a second pressure application pad (elastic pad). It is for pressing the pressure application belt 21 toward the fixation belt 20 (toward fixation pad 24). It is disposed in parallel to the pressure application roller 26, and also, in contact with the pressure application roller 26.

The pressure application pad 27 is formed of heat resistant elastic material, more specifically, heat resistant silicone rubber. It is 3 mm in thickness and 15 mm in width.

Further, in order to reduce the frictional resistance of the pressure application pad 27 against the inward surface of the pressure application belt 21 and the peripheral surface of the pressure application roller 26, the pressure application pad 27 is provided with a cover formed of a low friction sheet, as is the fixation pad 24. The cover is formed by coating glass fiber cloth with fluorinated resin. This cover covers the surface of the heat resistant silicone rubber of which the pressure application pad 27 is formed.

In order to form the fixation nip between the fixation pad 24 and pressure application pad 27, the pressure application pad 27 is kept pressed in the direction indicated by an arrow mark in FIG. 1, by a pressure application mechanism which applies a preset amount of pressure upon the base plate of the pressure application pad 27, which supports the silicone rubber portion of the pressure application pad 27. Further, in order to prevent the fixation pad 24 from vertically moving, the fixation pad 24 is fixed to the frame of the fixing apparatus A.

As for the pressure application roller 26 by which the pressure application belt 21 is suspended, the lengthwise ends of its rotational shaft are kept pressed toward the fixation roller 23, that is, in the direction indicated by an arrow mark in FIG. 1, by a preset amount of pressure generated by a pressure application mechanism. As for the fixation roller 23, it is attached to the frame of the fixing apparatus A to prevent it from vertically moving. Obviously, it is attached to the frame of the fixing apparatus A with a pair of bearings placed between the fixation roller 23 and the frame to allow the fixation roller 23 to rotate.

With the employment of the structural arrangement described above, it is possible to form a fixation nip which is satisfactorily long in the recording sheet conveyance direction. In order to prevent the formation of a fixation nip that has areas which are substantially lower in pressure than the adjacent areas, the downstream edge portion (in terms of recording sheet conveyance direction) of the pressure application pad 27 is kept wedged in the wedge-shaped space Z (FIG. 1) which is between the pressure application belt 21 and pressure application roller 26. In other words, in order to ensure that the above described set-up is achieved, the pressure application pad 27 (cover of pad 27 which will be described later) is disposed so that it contacts both the pressure application belt 21 and pressure application roller 26.

Incidentally, in order to ensure that the portion of the pressure application pad 27, which is to be placed in the wedge-shaped space Z, keeps the pressure application belt 21 pressed toward the fixation belt 20, a piece of wire as an auxiliary pressure application member may be put through this portion of the pressure application pad 27, from one end of the pressure application pad 27 to the other (in terms of direction perpendicular to recording sheet conveyance direction). More specifically, the piece of wire is fixed to the abovementioned heat resistant silicone rubber, of which the pressure application pad 27 is made. Providing the pressure application pad 27 with this piece of wire as an auxiliary pressure application member compensates for the pressure deficiency in the portion of the fixation nip, which corresponds to the space Z. The wire is covered with the low friction cover, along with the silicone rubber described above. The low friction cover will be described later.

Referring again to FIG. 1, the employment of the structural arrangement described above makes it possible to form a wider fixation nip, which extends from a point P (upstream end, in terms of recording sheet conveyance direction, of portion corresponding to both pressure pads) to a point Q (downstream end, in terms of recording sheet conveyance direction, of portion corresponding to fixation roller 23 and pressure application roller 26). Further, it places the pressure application pad 27 in contact with the pressure application roller 26 which is small in frictional load (coefficient of friction). It also places the fixation pad 24 near the fixation roller 23 which is larger in frictional load (coefficient of friction), that is, with a presence of a minute gap between the fixation pad 24 and fixation roller 23. Obviously, the coefficient of friction of the pressure application roller 26 is smaller than that of the fixation roller 23. The coefficients (dynamic coefficients) of friction of the pressure application roller 26 and fixation roller 23 can be measured with the use of a method which will be described later. In this embodiment, which is greater in coefficient of friction, the pressure application roller 26 or fixation roller 23, is determined by placing the pressure application roller 26 and fixation roller 23 in contact with a common piece of medium (test piece, in this embodiment, which will be described later) when measuring the coefficients of friction of the pressure application roller 26 and fixation roller 23.

In other words, the employment of the structural arrangement, in this embodiment, for a fixing apparatus makes it possible to form an excellent fixation nip not only between the fixation roller 23 and pressure application roller 26, but also between the fixation pad 24 and pressure application pad 27, while minimizing the increase in the amount of torque necessary for driving the fixation belt 20. Further, it can also minimize in size the areas of the fixation nip, which is substantially lower in pressure than the adjacent areas, in terms of recording sheet conveyance direction.

The aforementioned coefficients of friction of the pressure application roller 26 and pressure application pad 27 (covered with above described cover) can be measured with the use of the following method. In this embodiment, the pressure application roller 26 is formed of SUS. Thus, first, the test piece (3 cm×4 cm) is formed of the same SUS as that of which the pressure application roller 26 is formed. Then, the pad cover alone of the pressure application pad 27 is prepared (the same substance as the material for pad cover may be prepared). Then, the test piece formed of SUS is placed on the pad cover alone, and a preset amount of load (which in this embodiment is 210 g) is placed on the test piece. Then, the test piece formed of SUS is pulled at a preset speed (which in this embodiment is 200 mm/sec), with the pad cover kept stationary. Then, the amount of force necessary to move the test piece at a steady speed (200 mm/sec) after the test piece begins to move is measured several times with a digital force gauge. The results of the several measurements are averaged to obtain the amount of force necessary to pull the test piece formed of SUS. Then, the coefficient (μ) of friction of the test piece formed of SUS is calculated from the relationship ($F=\mu N$) between "the amount of force (F) necessary to pull the test piece" and "load (N)". The temperature of the ambience in which the coefficient of friction of the pressure application roller 26 was measured was 23° C. The coefficients of friction of the pressure application roller 26 relative to the pressure application pad 27 (pad cover of pressure application pad 27), which was obtained through the above described process, was 0.15.

Reducing the pressure application roller 26 in coefficient of friction as described above contributes to the formation of a fixation nip having no area which is substantially lower in pressure than the adjacent areas, while preventing the amount of force necessary to move the pressure application belt 21, from becoming excessively large.

On the other hand, in order to enable the fixation roller 23 to fulfill its function as a driving roller, an elastic roller which is large in coefficient of friction is employed as the fixation roller 23, as described above. Thus, the fixation pad 24 is not placed in contact with the fixation roller 23, although it is placed close to the fixation pad 24. Therefore, while the fixation belt is rotated, the fixation pad 24 contributes to the stabilization of the fixation belt 20, without excessively increasing the amount of torque necessary to drive the fixation roller 23 to move the fixation belt 20.

As described above, the employment of the fixation pad 24, fixation roller 23, pressure application pad 27, and pressure application roller 26, which are the means for forming a fixation nip, makes it possible to form the continuous fixation nip, which extends in the recording sheet conveyance direction, between the fixation belt 20 and pressure application belt 21.

More specifically, the portion of the fixation belt 20, which is between the upstream edge of the fixation pad 24, in terms of the recording sheet conveyance direction, and the fixation roller 23, is pressed toward the pressure application belt 21 by the fixation pad 24, and the portion of the pressure application belt 21, which is between the upstream edge of the pressure application pad 27 and the pressure application roller 26, is pressed toward the fixation belt 20 by the pressure application pad 27. Further, the structural arrangement described above prevents the formation of a fixation nip, the area of which between the portion between the fixation roller 23 and pressure application roller 26, and the portion between the fixation pad 24 and pressure application pad 27 has areas which are substantially lower in pressure than the adjacent areas. Therefore, this embodiment can form a fixation nip which is satisfactorily long in terms of the recording sheet conveyance direction, and yet, does not have areas which are substantially lower in pressure than the adjacent areas, in terms of the recording sheet conveyance direction.

In this embodiment, the width of the fixation nip between the fixation belt 20 and pressure application belt 21, in terms of the recording sheet conveyance direction, is roughly 18 mm. Since the fixation nip is wide, an image can be satisfactorily fixed even if image formation speed is increased. Further, in this embodiment, an endless belt is employed, as a member directly involved in image fixation, by both the fixation side (heat application side) and pressure application side. Therefore, it is possible to reduce the fixing apparatus in thermal capacity, reducing thereby the warm-up time (time necessary for fixing apparatus to become ready for image fixation after main power source of image forming apparatus is turned on), compared to a fixing apparatus in accordance with the prior art.

At least during an image forming operation, the fixation belt 20 is rotated in the direction indicated by an arrow mark X in FIG. 1, by the rotation of the fixation roller 23 which is rotated by a motor. In order to cause the sheet S of recording medium to bow, the circumferential velocity of the fixation belt 20 is set to a velocity that is slightly lower than the velocity at which the sheet S of recording medium is conveyed to the fixation belt 20 from the image forming portion.

The pressure application belt 21 rotates in the direction of the arrow mark Y following the movement of the fixation belt 20. The fixing apparatus A in this embodiment is structured so that the fixation belt 20 is rotated the fixation roller 23, with the portion of the fixation belt 20 and the portion of the pressure application belt 21, which correspond to the most downstream portion of the fixation nip (portion which is highest in pressure in terms of pressure distribution (in recording sheet conveyance direction), pinched with the pair of rollers (fixation roller 23 and pressure application roller 26. Therefore, the belts are prevented from slipping. In this embodiment, the circumferential velocity of the fixation belt 20 is set to 300 mm/sec, making it possible to form 70 full-color images of A4 size per minute.

In the case of a fixing apparatus such as the one described above, the sheet S of recording medium bearing an unfixed toner image is conveyed to the fixation nip, after the temperature of the fixation belt 20 reaches a preset fixation temperature (which in this embodiment is 190° C.). Then, the sheet S is introduced into the fixation nip, with its surface, on which the unfixed toner image is borne, facing the fixation belt 20. Then, the sheet S is conveyed through the fixation nip, with the unfixed toner image T on the sheet S kept thoroughly in contact with the outward surface of the fixation belt 20. Therefore, heat and pressured are applied to the sheet S and the unfixed toner image T thereon. As a result, the unfixed toner image is fixed to the sheet S. The heat is applied primarily from the fixation belt 20.

Further, the fixation roller 23, which is disposed within the fixation belt loop, is an elastic roller having a rubber layer, and the pressure application roller 26, which is disposed within the pressure belt loop is a rigid roller formed of a metallic substance. Therefore, the deformation (indentation) of the fixation roller 23 is substantial near the exit portion of the fixation nip. Therefore, the deformation of the fixation belt 20 is also substantial near the exit portion of the fixation nip. Therefore, the sheet S, which is bearing the toner image, is separated from the fixation belt 20 by the curvature of the fixation roller 2 (fixation belt 20), and the resiliency of the sheet S itself.

The employment of the structural arrangement described above prevents the formation of a fixation nip having areas which are substantially lower in pressure than the adjacent areas, while ensuring that the fixation belt is satisfactorily rotated and a sheet of recording medium is satisfactorily separated from the fixation belt.

Figure 3:
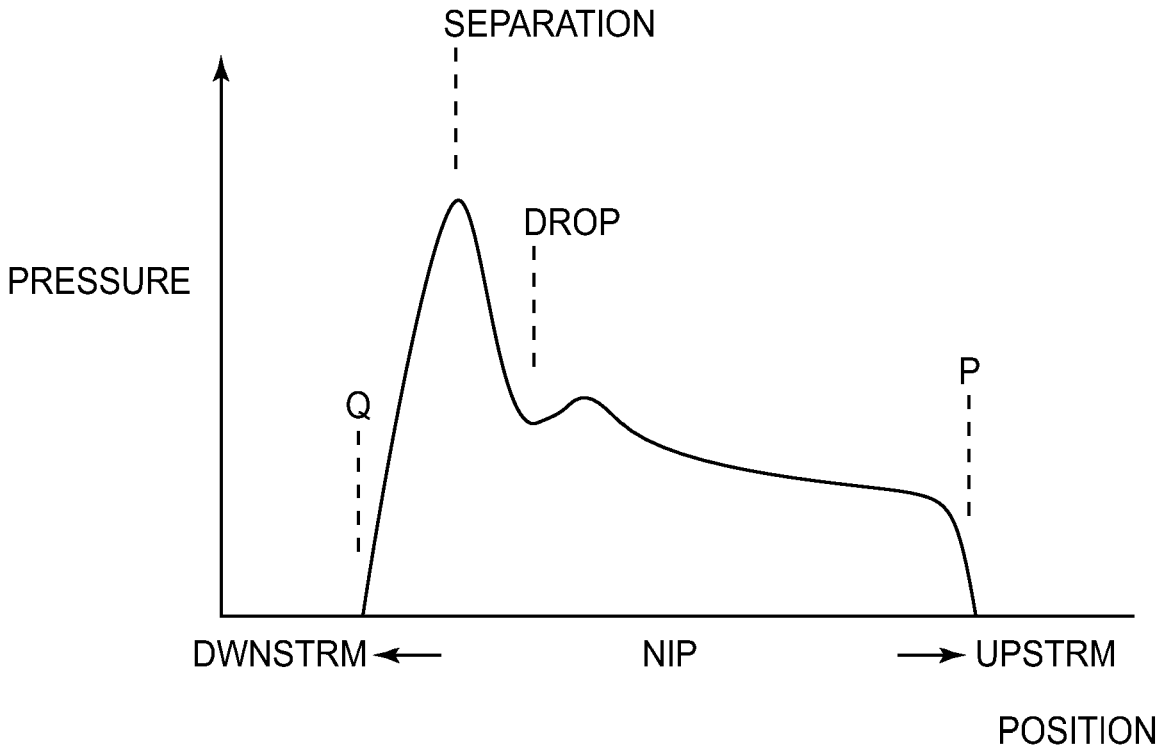
FIG. 3 is a graph showing the pressure distribution of the fixation nip of the fixing apparatus in the first embodiment of the present invention.

FIG. 3 is a graph showing the pressure distribution of the fixation nip, in terms of the direction parallel to the recording medium sheet conveyance direction. In this graph, the axis of ordinates represents the pressure, and the axis of abscissas represents the location in the fixation nip in terms of the sheet conveyance direction. The "upstream" of the axis of abscissas corresponds to the entrance side of the fixation nip, and the "downstream" of the axis of abscissas corresponds to the exit side of the fixation nip. As will be evident from the graph, the fixation nip in this embodiment does not have areas which are substantially lower in pressure than the adjacent areas, and the pressure of the fixation nip gradually increases from the upstream side toward the downstream side, being highest at the point of the sheet separation. Therefore, even though the fixation nip is wide in terms of the recording medium sheet conveyance direction, neither is it nonuniform in terms of the sheet conveyance speed, nor does it cause image deviation. Further, air and steam are not trapped in the fixation nip. Therefore, an image which is nonuniform in glossiness is not yielded.

Given in the following table (Table 1) are the results of the evaluation of the relationship between the gap, in terms of recording medium sheet conveyance direction, between the fixation roller 23, and the fixation pad 24 disposed near the fixation roller 23 (with no contact between fixation pad 24 and fixation roller 23), and the occurrences of the image defects.

TABLE 1

| | roller-pad distances | | | |
|---|---|---|---|---|
| | 3 mm | 4 mm | 5 mm | 7.5 mm |
| plain paper | G | G | G | N |
| coated paper | G | G | G | N |

G: No image defect.
N: Image defect is seen.

As recording medium, sheets of ordinary recording paper and sheets of coated paper were used. Coated paper is lower in air permeability than ordinary paper. Therefore, when coated paper is used, it is more likely for a defective image to be yielded than when the ordinary paper is used. Further, it was confirmed that the formation of a defective image, more specifically, an image suffering from positional deviation, nonuniformity in glossiness, etc., can be prevented by setting the gap between the fixation roller 23 and fixation pad 24 to a value no more than 5 mm. On the other hand, from the standpoint of preventing the fixation roller 23 and fixation pad 24 from accidentally coming in contact with each other, the minute gap between the fixation roller 23 and fixation pad 24 is desired to be set to a value no less than 0.1 mm.

The examinations of the abovementioned results by the inventors of the present invention revealed that as long as the coefficient of friction of the pressure application roller 26 relative to the pressure application pad 27 is made to be no more than 0.5, it does not occur that the revolution of the pressure application roller 26 is affected by the load increase attributable to the contact between the pressure application roller 26 and pressure application pad 27. Incidentally, when the coefficient of friction of the pressure application roller 26 relative to the pressure application pad 27 was no less than 0.5, the cover of the pressure application pad 27 was dragged into the interface between the pressure application roller 26 and the pressure application belt 21, being thereby damaged. The method used for measuring the coefficient of friction of the pressure application roller 26 relative to the pressure application pad 27 was the same as that described before.

Shown in FIG. 2 is a comparative fixing apparatus in which the pressure application pad 27 is disposed with no contact between the pressure application pad 27 and pressure application roller 26.

In the fixing apparatus structured as shown in FIG. 2, the gap between the pressure application roller 26 and pressure application pad 27 and the gap between the fixation roller 23 and fixation pad 24 correspond in position in terms of the recording sheet conveyance direction.

Figure 4:
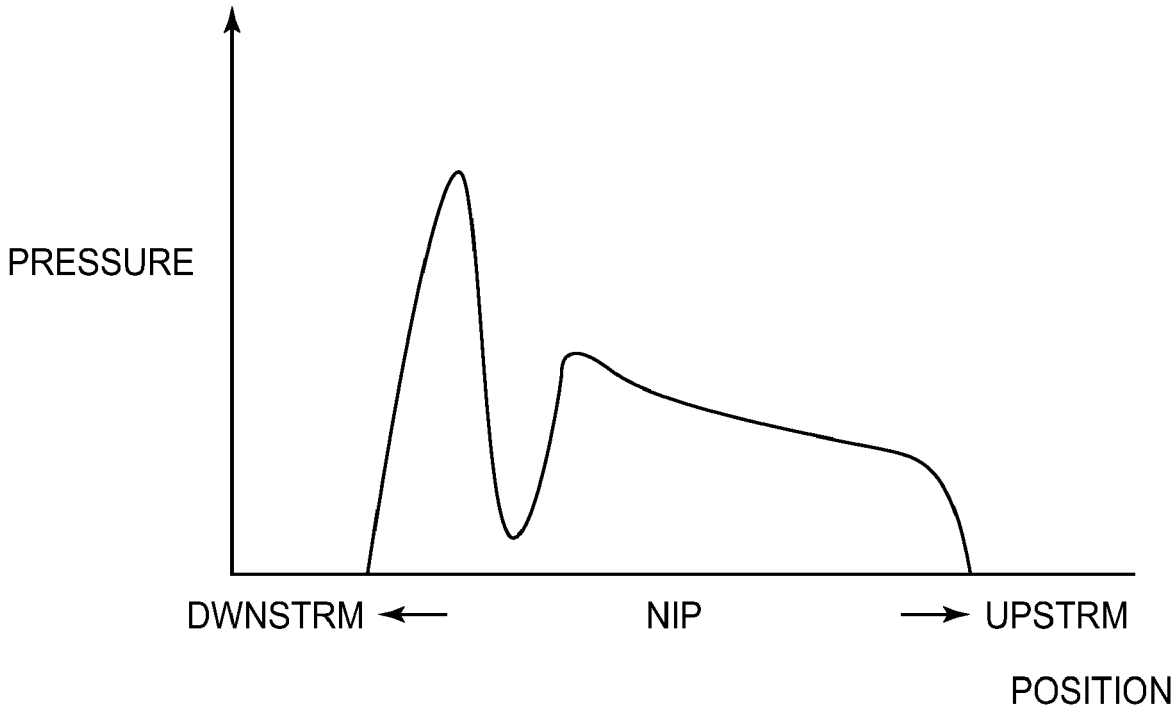
FIG. 4 is a graph showing the pressure distribution of the fixing nip of the first comparative fixing apparatus.

FIG. 4, which is similar to FIG. 3, is a graph showing the pressure distribution of the fixing nip of the comparative fixing apparatus described above. As will be evident from FIG. 4, the portion of the fixation nip of this comparative fixing apparatus, which corresponds in position to the gap between the pressure application roller 26 and pressure application pad 27 and the gap between the fixation roller 23 and fixation pad 24, in terms of the recording sheet conveyance direction, is substantially lower in pressure than its adjacencies.

When unfixed toner images were fixed to sheets of ordinary paper and sheets of coated paper, using the comparative fixing apparatus in which the gap between the pressure application roller 26 and pressure application pad 27 was set to 3 mm, it was confirmed that the usage of coated paper resulted in the yielding of the images which were nonuniform in glossiness, but the usage of ordinary paper did not.

Further, another comparative fixing apparatus, which was structured so that the fixation pad 24 was disposed in contact with the fixation roller 23, was evaluated. In the case of this comparative fixing apparatus, the friction between the fixation roller 23 and fixation pad 24 increased the amount of torque necessary to drive the fixing apparatus. Thus, as the fixation belt 20 was rotated, the cover of the fixation pad 24 was dragged into the interface between the fixation roller 23 and fixation belt 20, being thereby damaged.

As described above, in this embodiment, the fixation pad 24 is disposed close to, but, not in contact with, the elastic fixation roller 23, whereas the pressure application pad 27 is disposed in contact with the rigid pressure application roller 26. Therefore, it is possible to form the fixation nip, which is satisfactorily long in the direction parallel to the sheet conveyance direction, and yet, does not have areas which are substantially lower in pressure than the adjacent areas. In other words, the fixation nip of the fixing apparatus in this embodiment does not have areas which are substantially lower in pressure than the adjacent areas, making it possible to prevent the occurrences of image defects such as image deviation, nonuniformity in glossiness, etc.

Embodiment 2

Next, the fixing apparatus and image forming apparatus in the second embodiment of the present invention will be described. The sectional views of these apparatuses are the same as those for the first embodiment. Therefore, the apparatuses will be described with reference to FIG. 1.

The fixation pad 24 in this embodiment is formed of a resin, more specifically, PPS (polyphenyl sulphide resin). However, the material for the fixation pad 24 does not need to be limited to resin, as long as the resultant fixation pad 24 is rigid and is not provided with the elastic rubber layer. For example, it may be formed of a metallic substance. Otherwise, the structure of the fixing apparatus in this embodiment is the same as that in the first embodiment.

In the case of a fixing apparatus, such as the one in the first embodiment, which employs a fixation pad formed of rubber, there is the fear that as the fixation nip is formed (as pressure is applied), the elastic deformation of the fixation pad may result in the contact between the fixation pad and fixation roller. Further, using rubber as the material for the fixation pad limits the amount by which the portion of the fixation nip corresponding to the "dip" in FIG. 3 can be increased in pressure.

In this embodiment, therefore, the fixation pad is formed of a highly rigid resin, or a metallic substance. In other words, the fixation pad is rendered greater in hardness than the pressure application pad. Therefore, the fixation pad is prevented from accidentally coming into contact with the fixation roller as the fixation nip is formed (as pressure is applied). Further, using a highly rigid resin or a metallic substance as the material for the fixation pad makes it possible to increase in pressure the portion of the fixation nip corresponding to the "dip" in FIG. 3. In particular, using a metallic substance as the material for the fixation pad makes it easier to accurately control the size of the gap between the fixation roller 23 and fixation pad 24. Therefore, the structural arrangement in this embodiment is preferable.

As described above, in this embodiment, the fixation pad is disposed in parallel to the fixation roller, with the presence of a minute gap between the pad and roller. Therefore, it is ensured that a minute gap is maintained between the fixation roller 23 and fixation pad 24. Incidentally, also in this embodiment, this minute gap is set to 3 mm.

As described above, in this embodiment, a rigid pad, which is smaller in the amount of the deformation which occurs within the normal range of the pressure applied to the fixation pad while the apparatus is in use, is employed as the fixation pad which is disposed in parallel to the fixation roller, with the provision of a minute gap between the pad and roller, and an elastic pad is employed as the pressure application pad placed in contact with the pressure roller. Therefore, it is possible to increase in pressure the portion of the fixation nip, which corresponds to the "dip" in FIG. 3.

Obviously, like the fixing apparatus in the first embodiment, the fixing apparatus in this embodiment can form a fixation nip which is satisfactorily long in terms of the sheet conveyance direction, and yet, does not have areas which are substantially lower in pressure than the adjacent areas. Therefore, it is possible to prevent the occurrences of image defects such as image deviation, nonuniformity in glossiness, etc.

Embodiment 3

Figure 5:
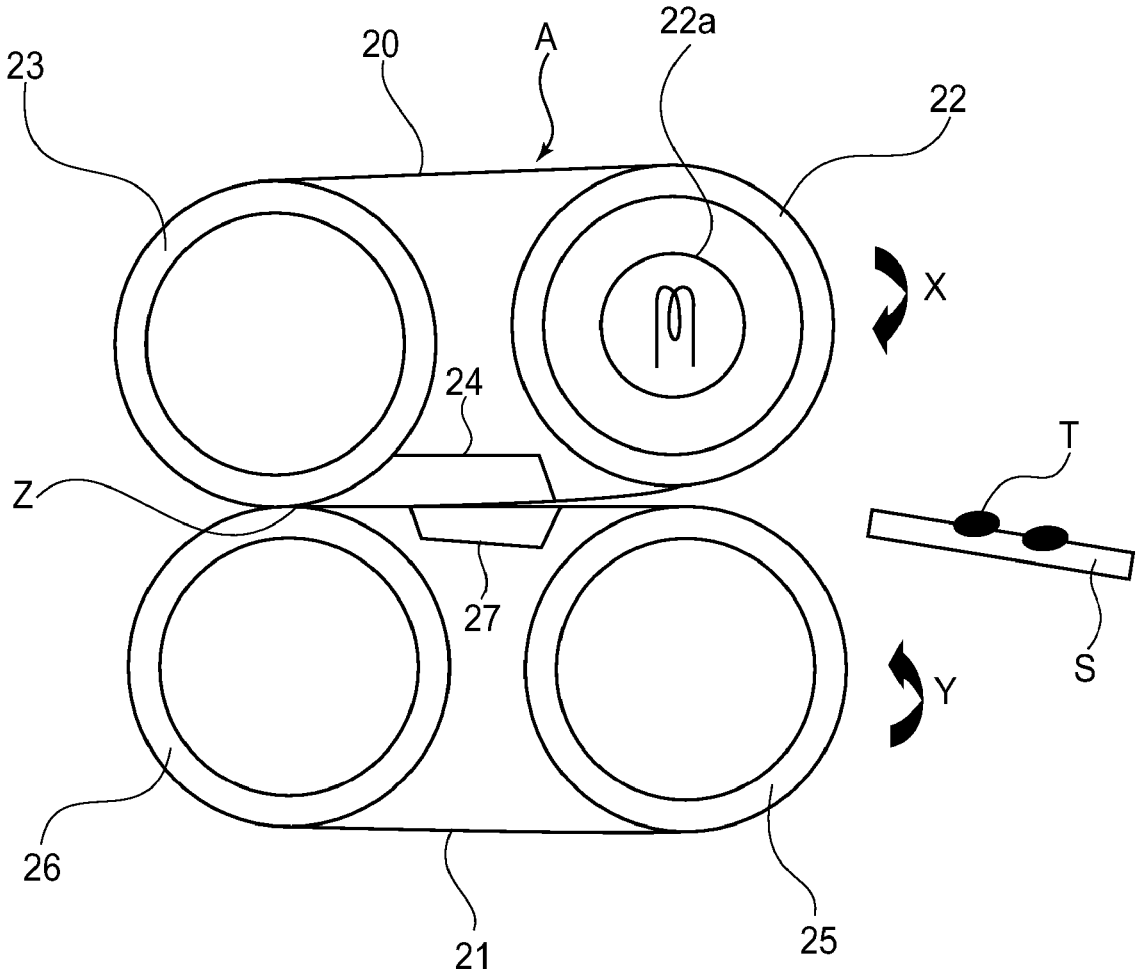
FIG. 5 is a schematic sectional view of a fixing apparatus structured differently from the fixing apparatuses in the first and second embodiments of the present invention, simply showing the structure thereof.

FIG. 5 is a drawing which simply shows the fixing apparatus in another embodiment of the present invention. The fixing apparatus in this embodiment is reverse to the fixing apparatus in the first embodiment, in terms of the structures of the fixation side and pressure application side.

More specifically, in this embodiment, a rigid roller is employed as the fixation roller 23, which is disposed within the loop of the fixation belt 20, and an elastic pad is employed as the fixation pad 24. Further, the fixation pad 24 is disposed in contact with the fixation roller 23.

Moreover, an elastic roller is employed as the pressure application roller 26 (which is given the function of receiving inputted driving force and transmitting it to pressure application belt), which is disposed within the loop of the pressure application belt 21, and a rigid pad is employed as the pressure application pad 27, which in this embodiment is disposed close to the pressure application roller 26, with no contact between the pressure application pad 27 and pressure application roller 26.

The fixation belt 20 in this embodiment is not provided with an elastic layer; a belt identical to the pressure belt 21 in the first embodiment is used as the fixation belt 20 in this embodiment. The pressure application belt 21 is rotated by driving the pressure application roller 26 by a motor, and the fixation belt 20 is rotated by the rotation of the pressure application belt 21. In other words, the structures of the fixation side and pressure application side of the fixing apparatus in this embodiment are reverse to those in the second embodiment, except for the positioning of the halogen heater 22*a*.

The structural arrangement in this embodiment described above can also yield the same effects as those yielded by the structural arrangements in the first and second embodiments. That is, it can form a fixing nip having no area which is substantially lower in pressure than the adjacent areas. Therefore, it can prevent the occurrences of the image defects such as image deviation, nonuniformity in glossiness, etc.

Incidentally, the structural arrangement in the second embodiment described above can be incorporated into the structural arrangement in this embodiment.

In the first to third embodiments described above, the image heating apparatus was a fixing apparatus. However, the present invention is also applicable to an image heating apparatus other than a fixing apparatus. For example, it is also applicable to a glossiness improving apparatus for reheating a toner image, which has been temporarily fixed to a sheet of recording medium by a fixing apparatus, in order to improve the toner image in glossiness.

Also in the first to third embodiments, a halogen heater was employed as the heat source for the fixation belt. However, a heat source based on electromagnetic induction (for example, excitation coil), which is very high in energy efficiency, may be employed instead of a halogen heater. When a heat source based on electromagnetic induction is employed, the fixation belt is provided with an electrically conductive layer in which heat is generated by the electric current electromagnetically induced therein by the magnetic flux generated by an excitation coil.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 180540/2005 filed Jun. 21, 2005 which is hereby incorporated by reference.

What is claimed is:

1. An image heating apparatus comprising:

first and second belts forming a nip for heating a toner image on a recording material, wherein said second belt is rotatable by a driving force received from said first belt;

a first roller for pressing said first belt to said second belt in said nip, wherein said first roller is effective to rotate said first belt;

a first pad for pressing said first belt to said second belt in said nip;

a second roller for pressing said second belt to said first roller in said nip, wherein said second roller has a coefficient of friction that is smaller than a coefficient of friction of said first roller; and a second pad for pressing said second belt to said first pad in said nip, wherein said second pad is disposed closer to a region where said first belt and second belt are pressed by said first roller and said second roller than said first pad.

2. An apparatus according to claim 1, wherein said first pad is spaced from said first roller with a gap, and said second pad is contacted to said second roller.

3. An apparatus according to claim 2, wherein said second pad is contacted to said second roller so as to be substantially packed in a wedge shape space formed between said second roller and said second belt.

4. An apparatus according to claim 2, wherein said first roller has a surface of rubber material and said second roller has a surface of metal.

5. An apparatus according to claim 2, wherein the gap is 0.1 mm-5.0 mm.

6. An apparatus according to claim 2, wherein said first roller is disposed downstream of said first pad with respect to a feeding direction of the recording material, and said second roller is disposed downstream of said second pad with respect to the feeding direction.

7. An apparatus according to claim 2, wherein said first belt is contactable to a toner image on the recording material.

* * * * *